US010477986B2

(12) United States Patent
Leonard

(10) Patent No.: US 10,477,986 B2
(45) Date of Patent: Nov. 19, 2019

(54) FAN PLENUM ASSEMBLY AND ATTACHMENT IN A MERCHANDISER

(71) Applicant: Hussmann Corporation, Bridgeton, MO (US)

(72) Inventor: Larry N. Leonard, Saint Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 699 days.

(21) Appl. No.: 14/992,632

(22) Filed: Jan. 11, 2016

(65) Prior Publication Data

US 2017/0196376 A1 Jul. 13, 2017

(51) Int. Cl.
*A47F 3/04* (2006.01)
*F04D 19/00* (2006.01)
(Continued)

(52) U.S. Cl.
CPC ..... *A47F 3/0447* (2013.01); *A47F 3/0469* (2013.01); *A47F 3/0482* (2013.01);
(Continued)

(58) Field of Classification Search
CPC .... A47F 3/0447; A47F 3/0469; A47F 3/0443; A47F 3/0482; F04D 19/002;
(Continued)

(56) References Cited

U.S. PATENT DOCUMENTS 472,622 A 4/1892 Linkletter
1,778,263 A 10/1930 Lamb
(Continued)

FOREIGN PATENT DOCUMENTS

JP 2001-099549 4/2001
JP 3842932 11/2006
(Continued)

OTHER PUBLICATIONS

PCT/US2016/057796 International Search Report and Written Opinion of the International Searching Authority dated Feb. 1, 2017 (9 pages).
(Continued)

*Primary Examiner* — Daniel J Troy
*Assistant Examiner* — Timothy M Ayres
(74) *Attorney, Agent, or Firm* — Michael Best & Friedrich LLP

(57) ABSTRACT

A fan plenum assembly for a merchandiser. The fan plenum assembly includes a plenum housing that defines an opening configured to receive a fan, and that has a side wall with a slot and a slot extension continuous with the slot. The slot has a major axis extending through a center of the slot. A bearing is configured to rotationally support a hinge pin and is coupled to the side wall. The bearing includes a positioning element that is disposed in the slot and in the slot extension. The positioning element is movable within the slot and the slot extension such that the bearing is movable along the major axis to permit axial adjustment of a position of the bearing relative to the plenum housing and the bearing is immovable rotationally relative to the plenum housing.

7 Claims, 8 Drawing Sheets

(51) Int. Cl.
*F04D 29/54* (2006.01)
*F04D 29/52* (2006.01)
*F04D 29/60* (2006.01)

(52) U.S. Cl.
CPC ..... *F04D 19/002* (2013.01); *F04D 29/522* (2013.01); *F04D 29/545* (2013.01); *F04D 29/601* (2013.01); *F25D 2317/0681* (2013.01)

(58) Field of Classification Search
CPC ..... F04D 29/545; F16C 17/02; E05D 11/02; E05D 11/06; E05D 11/10; E05D 11/1014; E05D 11/1021; E05D 11/1028; E05D 11/1042; E05D 11/105; E05D 11/1057; E05D 2011/1035
USPC ..... 312/116
See application file for complete search history.

(56) References Cited

U.S. PATENT DOCUMENTS 1,783,446 A 12/1930 Overbury
1,793,946 A * 2/1931 McEwan ..... B61D 17/10 105/375
3,954,311 A 5/1976 Pike
4,596,060 A 6/1986 Schmidt et al.
5,475,988 A * 12/1995 McGovern ..... A47F 3/0447 62/256
5,517,826 A * 5/1996 Duffy ..... A47F 3/0443 312/116
5,815,886 A 10/1998 Nishio et al.
6,132,128 A * 10/2000 Burrows ..... B60N 2/753 403/96
6,272,876 B1 * 8/2001 Roberts ..... A47F 3/0482 454/193
6,289,555 B1 * 9/2001 Nguyen ..... F24F 7/025 16/235
6,701,572 B2 * 3/2004 Bechthold ..... E05D 7/0045 16/235
6,978,516 B1 12/2005 Calderon et al.
7,429,039 B2 * 9/2008 Hattori ..... H04N 1/00519 16/239
7,546,998 B2 6/2009 Chen
8,535,128 B2 * 9/2013 Chwala ..... F24F 13/32 454/354
8,827,369 B2 9/2014 Izawa et al.
9,303,887 B1 * 4/2016 Chwala ..... F24F 13/32
9,456,706 B2 * 10/2016 Nguyen ..... A47F 3/0443
2005/0193755 A1 9/2005 Duffy
2008/0113611 A1 5/2008 Chwala
2015/0233164 A1 * 8/2015 Bacchetti ..... E05F 1/1223 16/54
2016/0215549 A1 * 7/2016 Bacchetti ..... E05F 1/1207

FOREIGN PATENT DOCUMENTS

JP 5138356 2/2013
KR 10-2000-0063060 10/2000

OTHER PUBLICATIONS

European Patent Office Extended Search Report for Application No. 16885386.9 dated Mar. 29, 2019 (8 pages).

* cited by examiner

FAN PLENUM ASSEMBLY AND ATTACHMENT IN A MERCHANDISER

BACKGROUND

The present invention relates generally to a fan plenum for a merchandiser, and particularly to a fan plenum and hinge pin bearing attachment.

Existing merchandisers typically include one or more fan plenums that assist with recirculating air within the merchandiser. However, conventional fan plenums cannot be easily removed to provide access to the fan for cleaning or maintenance. For example, some fan plenums require tools to disassemble the fan plenum from the merchandiser, which makes cleaning the fan and adjacent components somewhat difficult. In addition, existing fan plenums often do not properly seal against the interior bottom surface of the merchandiser. A poor seal between the fan plenum and the bottom surface results in poor air recirculation within the merchandiser.

SUMMARY

The present invention provides a fan plenum assembly for a merchandiser. The fan plenum assembly includes a plenum housing defining an opening configured to receive a fan. The plenum housing includes a side wall having a slot and a slot extension continuous with the slot. The slot has a major axis extending through a center of the slot. The plenum assembly also includes a bearing configured to rotationally support a hinge pin. The bearing is coupled to the side wall and includes a positioning element disposed in the slot and the slot extension. Engagement of the positioning element with the slot and the slot extension permits movement of the plenum housing relative to the bearing along the major axis to provide axial adjustment of the plenum housing while inhibiting rotational movement of the bearing relative to the plenum housing.

The present invention also provides a merchandiser including a case defining a product display area. The case includes a base and an air passageway extending from the base and in fluid communication with the product display area. The merchandiser also includes a plenum housing coupled to the case and substantially enclosing an end of the air passageway such that the plenum housing defines an opening configured to receive a fan to direct air into the air passageway, and the plenum housing includes a side wall having an edge oriented to engage a surface of the base and an elongated aperture with a major axis. A bearing is coupled to the side wall and defines a pivot for the plenum housing. The bearing includes a positioning element disposed within the aperture. A hinge pin is rotatably coupled to the bearing and defines a pivot about which the plenum housing is rotatable. Engagement of the positioning element with the aperture permits movement of the plenum housing relative to the bearing along the major axis to provide axial adjustment of the plenum housing while inhibiting rotational movement of the bearing relative to the plenum housing. Axial adjustment of the plenum housing along the major axis is configured to alter a position of the plenum housing relative to the support surface such that the edge of the plenum housing engages the base to limit air infiltration from adjacent the surface.

The present invention also provides a fan plenum assembly for a merchandiser. The fan plenum assembly includes a plenum housing defining an opening configured to receive a fan. The plenum housing includes a side wall having an elongated aperture with a major axis oriented along a length of the aperture. A bearing is coupled to the side wall and includes an attachment feature. The bearing is removably engaged with the side wall within the aperture by the attachment feature and defines a bearing hole configured to receive a hinge pin such that he plenum housing is slidable relative to the bearing along the major axis to different axial positions while the bearing remains engaged with the side wall.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
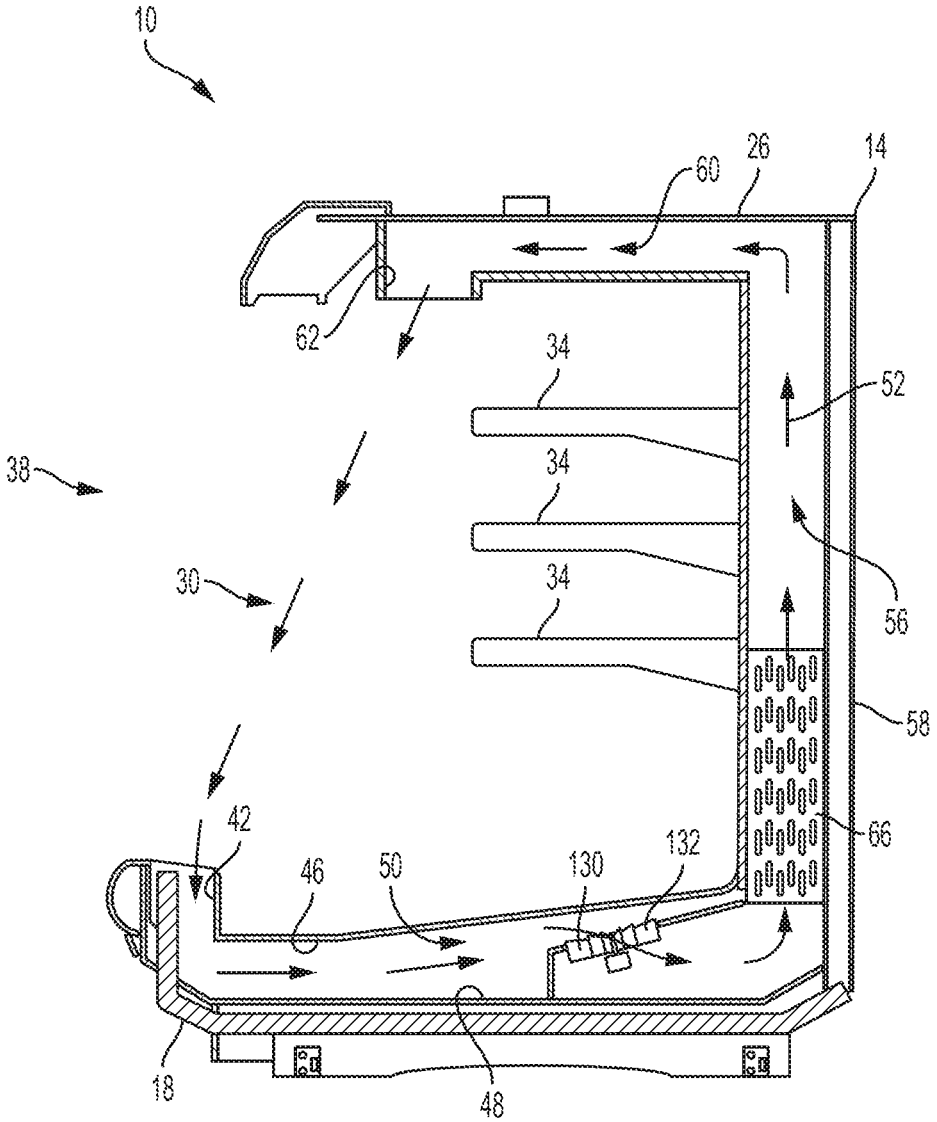
FIG. 1 is a cross-sectional view of a merchandiser including a case and a fan plenum assembly embodying the invention.
Figure 2:
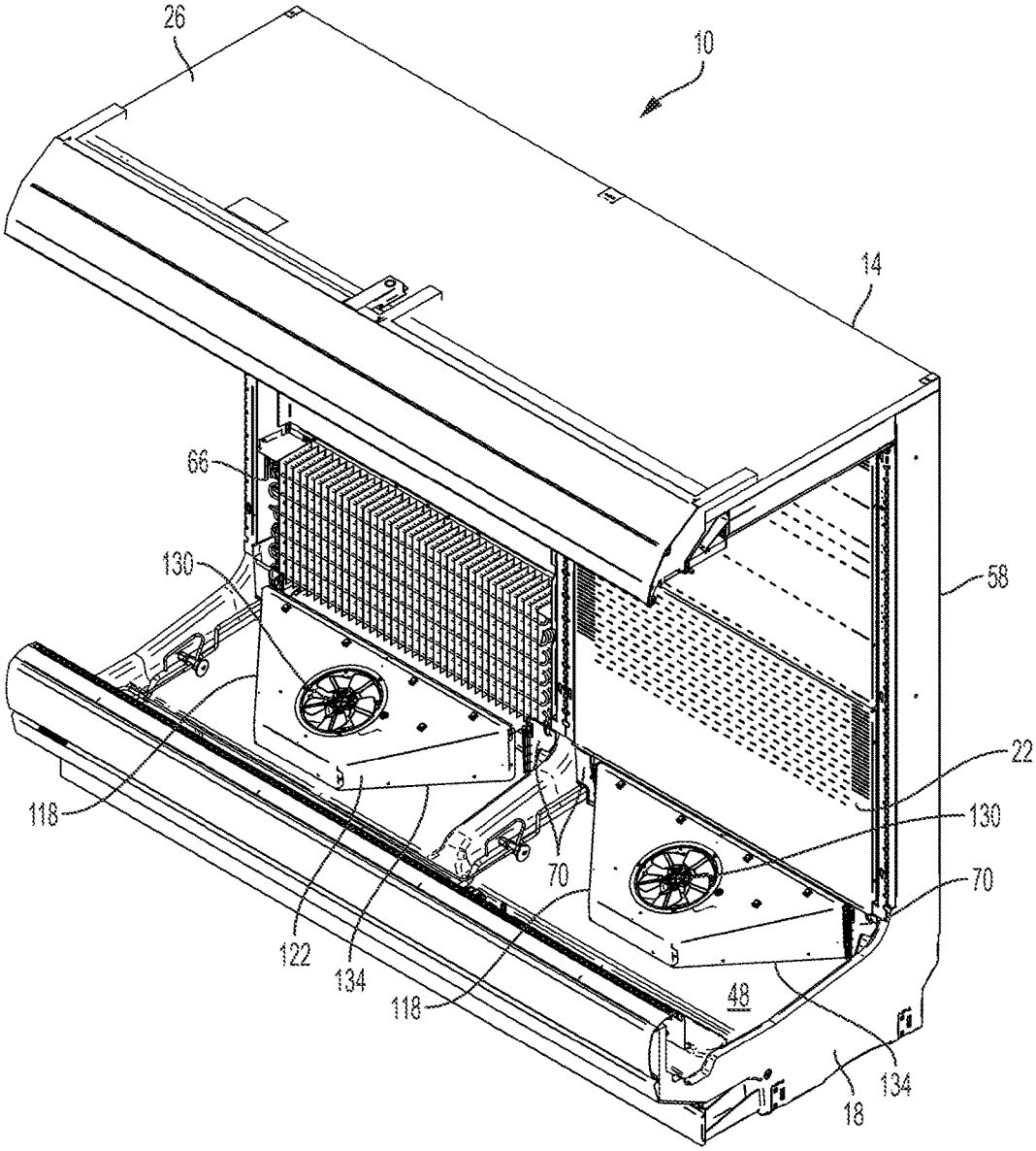
FIG. 2 is a perspective view of a portion of the merchandiser of FIG. 1 illustrating two fan plenum assemblies, with one fan plenum assembly partially detached from the case.

FIGS. 1 and 2 illustrate a refrigerated merchandiser 10 that may be located in a supermarket or a convenience store (not shown) for presenting fresh food, beverages, and other food product to consumers. The illustrated merchandiser 10 is an upright, open-front merchandiser 10, although other types of merchandisers 10 (e.g., horizontal merchandisers, etc.) fall within the scope of the invention. The merchandiser 10 includes a case 14 that has a base 18, a rear wall 22, and a canopy 26, and the area partially enclosed by the base 18, the rear wall 22, and the canopy 26 defines a product display area 30 that supports food product in the case 14. The merchandiser 10 can also include doors (not shown) to enclose the product display area 30. The food product is displayed on racks or shelves 34 extending forward from the rear wall 22, and is accessible by consumers through a customer access opening 38 adjacent the front of the case 14.

The illustrated base 18 is disposed substantially below the product display area 30 and supports the case 14 on a floor or support surface (not shown) of the retail setting. With reference to FIG. 1, the base 18 includes an air inlet 42 and a compartment 46 that is fluidly connected to the air inlet 42. The air inlet 42 is located adjacent a lower, front portion of the case below the customer access opening 38. The compartment 46 has an interior surface 48 and defines a lower air passageway 50 of the case 14. The air inlet 42 is oriented to receive surrounding air from within and adjacent the product display area 30 in a substantially vertical direction to direct the air into the lower air passageway 50.

The case 14 also has a rear air passageway 56 that is defined by the rear wall 22 and a back wall 58 of the case 14, and an upper air passageway 60 that is defined by the canopy 26. The air passageways 50, 56, 60 are fluidly connected to each other to direct an airflow (designated by arrows 52 in FIG. 1) from the inlet 42 to an outlet 62 of the canopy 26. The outlet 62 directs the airflow 52 generally downward toward the inlet 42 across a front of the product display area 30 in the form of one or more air curtains 64.

With reference to FIGS. 1 and 2, the merchandiser 10 includes a portion of a refrigeration system that has an evaporator 66 positioned in the rear air passageway to condition the product that is supported in the product display area 30. As will be appreciated, the evaporator 66 is fluidly coupled to a compressor (not shown) and a condenser (not shown) to define a circuit through which a heat transfer fluid is circulated to refrigerate the airflow 52. Such refrigeration systems are well known and will not be described in detail.

Figure 3:
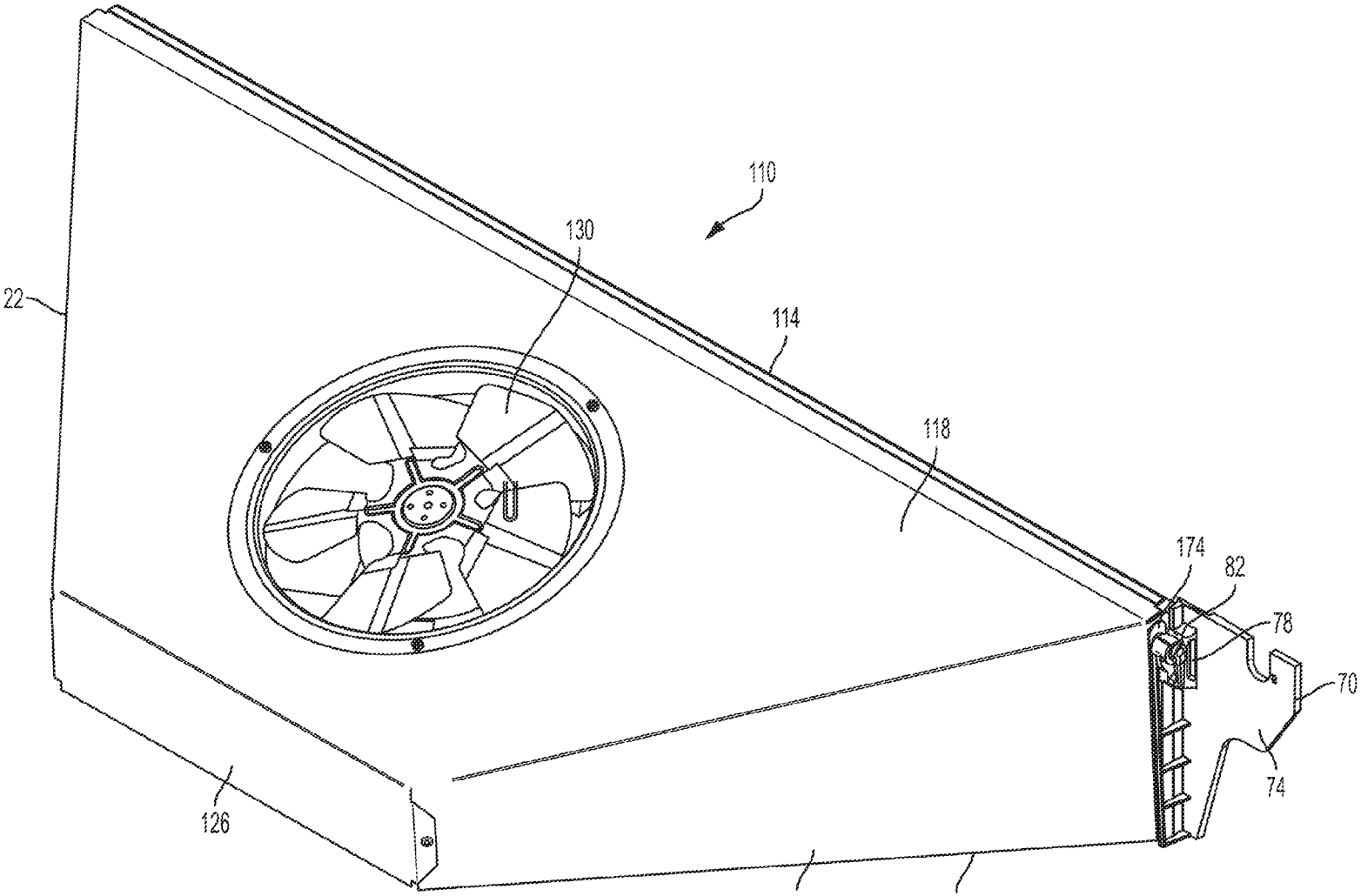
FIG. 3 is a perspective view of one fan plenum assembly illustrated in FIGS. 1 and 2.
Figure 4:
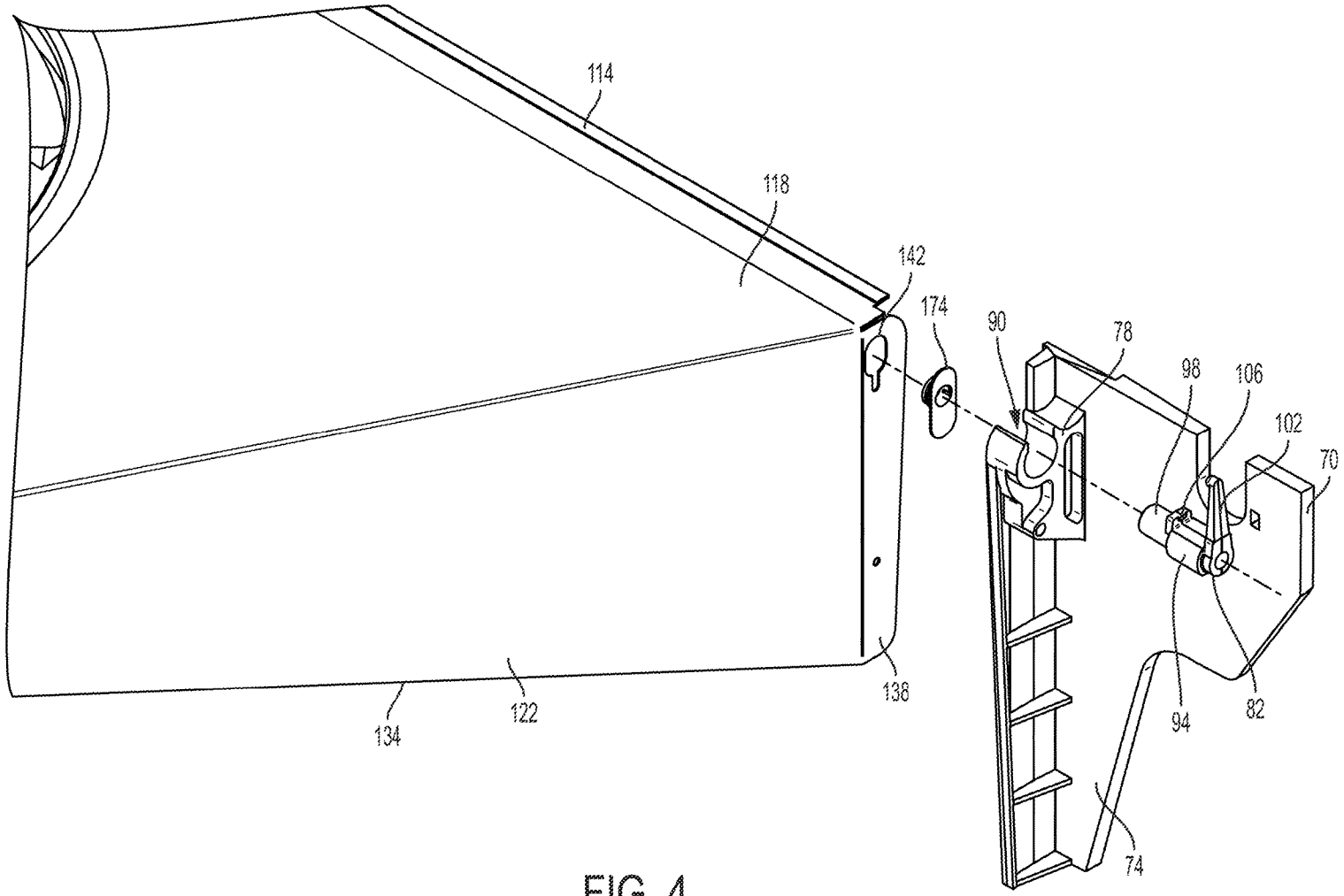
FIG. 4 is an exploded view of a portion of the fan plenum assembly of FIG. 3, illustrating coil supports, a plenum housing, a bearing, and a hinge pin.
Figure 5:
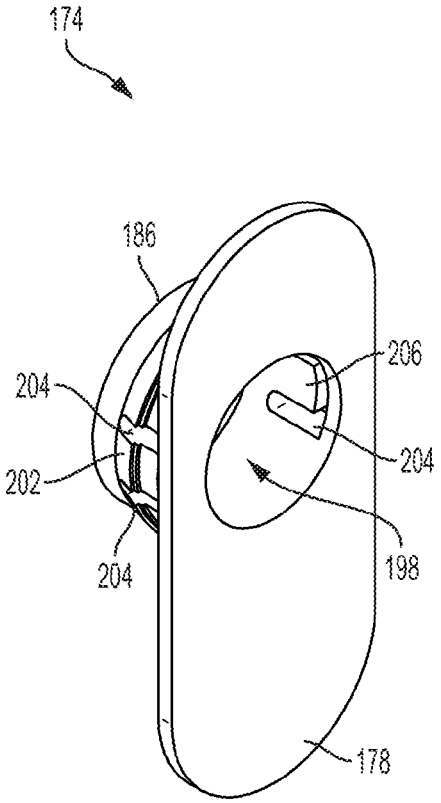
FIG. 5 is a perspective view of the bearing of FIG. 4.
Figure 6:
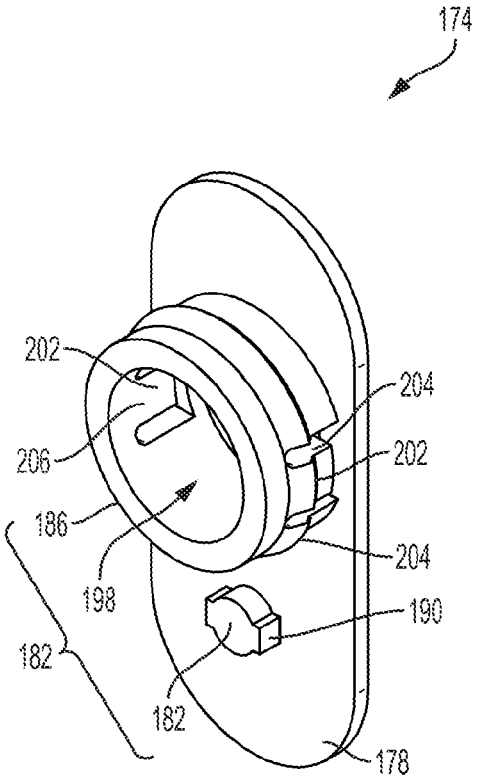
FIG. 6 is another perspective view of the bearing of FIG. 4.
Figure 7:
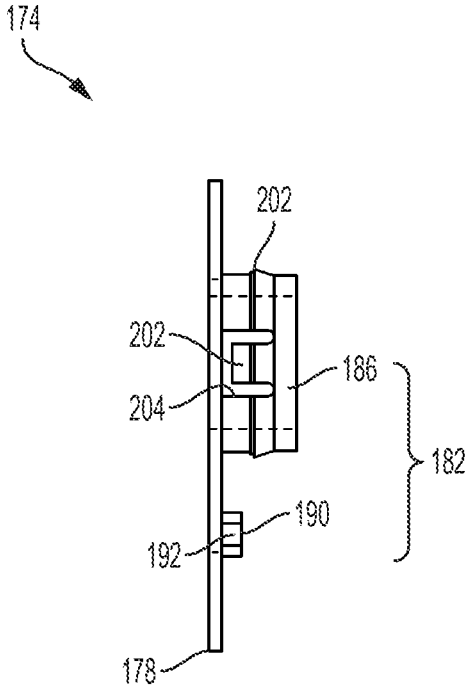
FIG. 7 is a side perspective view of the bearing of FIGS. 5 and 6.
Figure 8:
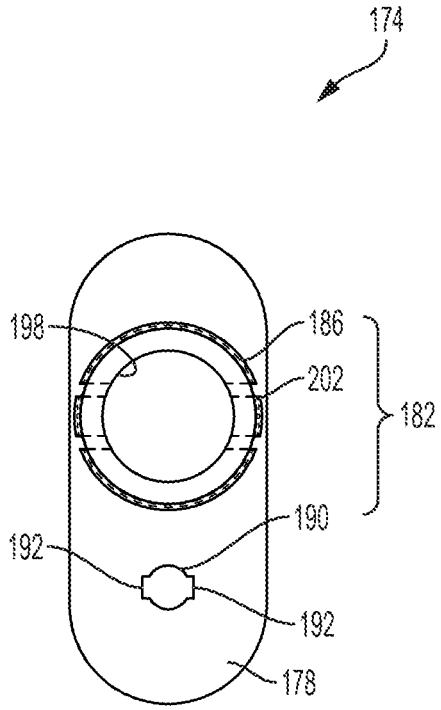
FIG. 8 is a front view of the bearing of FIGS. 5 and 6.

Referring to FIGS. 2-4, the evaporator 66 is positioned within and supported in the rear air passageway 56 by coil supports 70. Each coil support 70 includes a bracket portion 74 that is attached to the case 14, and a hinge pin mount 78 that rotatably supports a hinge pin 82. The illustrated hinge pin mount 78 defines a truncated, cylindrically-shaped cradle 86 that receives the hinge pin 82. Stated another way, the curved wall defining the cradle 86 has an open section 90 that permits attachment of the hinge pin 82 to the cradle 86.

FIG. 4 shows that the hinge pin 82 includes a lock portion 94 and a pin portion or barrel 98 that extends from the lock portion 94 along an axis 100 extending longitudinally through the hinge pin 82. The lock portion 94 has a handle 102 on the end opposite the barrel 98, and a lock tab 106 that is spaced from the handle 102 and that is positioned adjacent the transition from the lock portion 94 to the barrel 98 (i.e. at the interface between the lock portion 94 and the barrel 98). The lock portion 94 is engageable with the hinge pin mount 78 by inserting the hinge pin 82 axially into the cradle 86. The open section 90 permits passage of the lock tab 106 through the cradle 86. The lock portion 94 is rotatable to removably secure the hinge pin 82 to the hinge pin mount 78 without separate fasteners.

The merchandiser 10 also includes a fan plenum assembly 110 that is pivotably and removably coupled to the case 14 within the base 18 by the coil supports 70 and the hinge pins 82. The illustrated fan plenum assembly 110 includes a plenum housing 114 that has a top wall 118, side walls 122 extending downward from the top wall 118, and a front wall 126 extending downward from the top wall 118 between the side walls 122. As shown in FIGS. 1-3, a fan 130 is coupled to the plenum housing 114 within an opening 132 that is defined in the top wall 118. Referring to FIGS. 1 and 3, the lowermost edges of the side walls 122 and the front wall 126 (i.e. the edges that are engaged with the interior surface 48 of the base 18) define a rim 134 of the plenum housing 114.

The plenum housing 114 defines an enclosure or shell through which the airflow 52 generated by the fan 130 is directed toward the rear air passageway 56 and the evaporator 66. The rearward portion of the plenum housing 114 (toward the right in FIGS. 1, 3, and 4) is open to permit passage of air through the plenum housing 114 into the rear air passageway 56. With reference to FIGS. 1 and 3, the plenum housing 114 is wedge-shaped such that the top wall 118 angles upward from the front wall 126 toward the rear wall 22 of the case 14 (e.g., to facilitate directing the airflow 52 into the rear air passageway 56).

Figure 9:
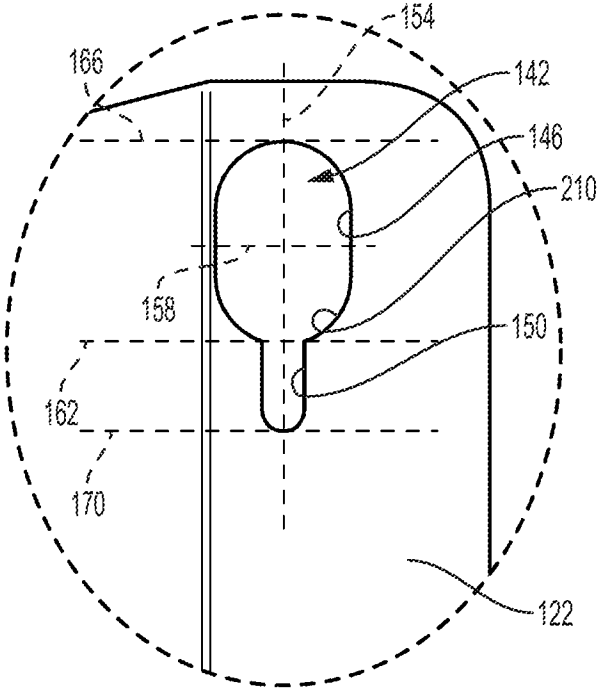
FIG. 9 is a side view of a portion of the plenum housing having an elongated aperture.

With reference to FIGS. 3, 4, and 9-11, each side wall 122 has a flange 138 that defines an elongated aperture 142 located adjacent a rear, upper corner of the side wall 122. As illustrated in FIG. 9, each aperture 142 is elongated in a vertical direction and is defined by an obround-shaped, elongated slot 146 and a slot extension 150 that extends from one side of the slot 146 along a major or longitudinal axis 154 of the aperture 142. As shown, the slot extension 150 is contiguous with the slot 146 and extends below the slot 146, although the slot extension 150 can extend above the slot 146. The aperture 142 also has a minor axis 158 that extends across a width of the slot 146 (perpendicular to the axis 154) and that bisects the slot 146 such that the intersection of the major and minor axes 154, 158 defines a center of the slot 146.

In general, the aperture 142 is elongated to permit vertical adjustment of the plenum housing 114 relative to the coil supports 70. The lengths and widths of the slot 146 and the slot extension 150 can vary. More specifically, although the illustrated slot extension 150 is narrower than the slot 146, the slot extension 150 can have the same width as the slot 146 or a larger width. Also, although the aperture 142 is illustrated and described with the slot 146 and the slot extension 150 having obround shapes, the slot 146 and the slot extension 150 can be defined by other shapes (e.g., rectangular, elliptical, etc.).

Figure 11:
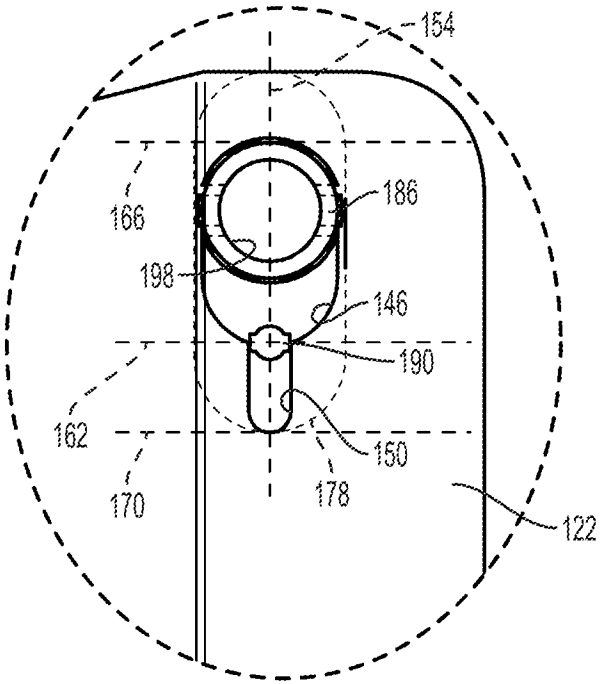
FIG. 11 is side view of the portion of the plenum housing of FIG. 9 including the bearing disposed in a second position within the aperture.
Figure 10:
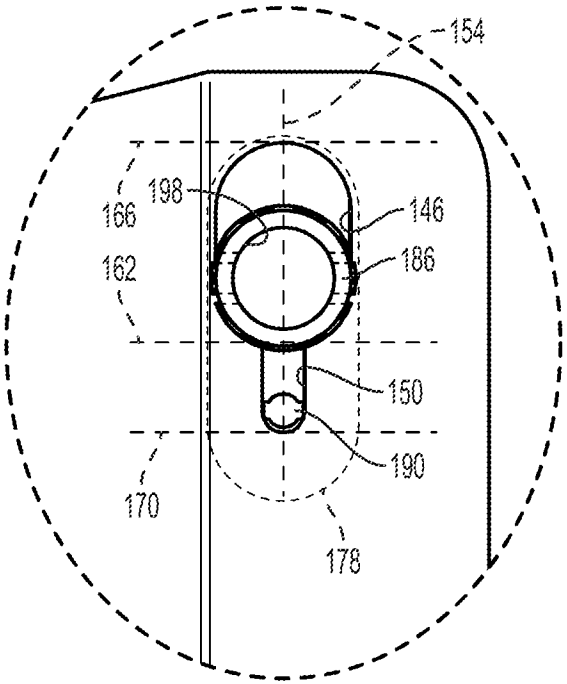
FIG. 10 is side view of the portion of the plenum housing of FIG. 9 including the bearing disposed in a first position within the aperture.

With reference to FIGS. 9-11, the slot 146 defines a first axial extent 162 at the lower edge of the slot 146, and a second axial extent 166 at the upper edge of the slot 146. The second axial extent 166 defines the interface or juncture between the slot 146 and the slot extension 150, and the slot extension 150 defines a third axial extent 170 at the lower edge of the slot extension 150. Stated another way, the first axial extent 162 defines a lower limit of the slot 146 (represented by a line that is tangent to the lower edge of the slot 146), the second axial extent 166 defines an upper limit of the slot 146 (represented by a line that is tangent to the upper edge of the slot 146), and the third axial extent 170 defines a lower limit of the slot extension 150 (represented by a line that is tangent to the lower edge of the slot extension 150).

The fan plenum assembly 110 also includes a hinge pin bearing 174 (referred to as a "bearing 174" for purposes of description and the claims) that is coupled to the plenum housing 114 within the aperture 142. The bearing 174 enables rotation or pivotal movement of the plenum housing 114 about the axis 100 of the hinge pin 82 (e.g., for cleaning or maintenance) while also permitting vertical adjustment of the plenum housing 114 relative to the coil supports 70 so that the rim 134 is in substantial contact with the interior surface 48 such that gaps between the interior surface 48 and the plenum housing 114 are minimized. In other words, vertical movement of the plenum housing 114 relative to the coil supports 70 adjusts the orientation or angle of the rim 134 relative to the interior surface 48 so that the rim 134 substantially or completely engages the interior surface to seal the interface between the plenum housing 114 and the interior surface.

With reference to FIGS. 4-8, the bearing 174 includes a base plate 178 and a positioning element 182 that extends from one side of the base plate 178. The base plate 178 is shaped to be larger than the aperture 142. The positioning element 182 includes a first protrusion 186 that is engageable with the slot 146, and a second protrusion 190 that is engageable with the slot extension 150. The illustrated first protrusion 186 has an annular, hollow wall 194 that forms a bearing surface (i.e. the annular wall 194 defines a bearing hole 198).

The first protrusion 186 an attachment feature 202 that is disposed on the exterior side of the annular wall 194. The illustrated attachment feature 202 is defined by a ridge or raised portion of the wall 194 and includes flexible detents or tabs. As shown, the attachment feature 202 includes two detents that are positioned on opposite sides of the first protrusion 186 and that are formed by cutouts 204 in the wall 194. The detents removably secure the bearing 174 to the plenum housing 114. The outer width or diameter of the annular wall 194 is the same or approximately the same as the width of the slot 146 so that the first protrusion 186 fits snugly into the slot 146. Although the illustrated bearing 174 illustrates the attachment feature 202 as detents 206, the first protrusion 186 can include another attachment feature to retain the bearing 174 in the aperture 142.

With reference to FIGS. 6-8, 10, and 11, the second protrusion 190 has opposite surfaces 192 (e.g., planar surfaces) that slide along the edges of the slot extension 150. In general, the second protrusion 190 can have any shape (e.g., polygonal such as rectangular or triangular, or non-polygonal such as cylindrical or elliptical, etc.) that permits insertion into the slot extension 150 and movement along the major axis 154 within the slot extension 150. The centers of the first protrusion 186 and the second protrusion 190 are aligned on the major axis 154. Although the first and second protrusions 186, 190 are described and illustrated as separate elements, the first and second protrusions 186, 190 may be formed as a singular, monolithic element.

To assemble the fan plenum assembly 110, bearings 174 are inserted into the apertures 142 on each flange 138 so that the first protrusions 186 are inserted into the respective slots 146 and the second protrusions 190 are inserted into the respective slot extensions 150. The detents 206 flex inward during insertion into the aperture 142 to permit passage of the first protrusion 186 into the slot 146, and flex outward upon full insertion to engage an inner side of the side walls 122 and retain the bearing 174 in engagement with the plenum housing 114. The plenum assembly 110 is positioned in the base 18 so that the bearing holes 198 align with the cradles 86. Each hinge pin 82 is then inserted through the cradle 86 so that the barrel 98 extends into the bearing hole 198. After the barrel 98 is inserted into the bearing 174, the hinge pin 82 is rotated within the cradle 86 via the handle 102 so that the lock tab 106 is no longer aligned with the open section 90. In this position, the lock tab 106 and the cradle 86 cooperatively prevent inadvertent removal of the hinge pin 82 from the bearing 174. To remove the fan plenum assembly 110 from the case 14, the above process is reversed. That is, the hinge pin 82 is rotated so that the lock tab 106 is aligned with the open section 90, and the hinge pin is then removed from the bearing 174 and the cradle 86 along the axis 100.

When assembled, the plenum housing 114 can be rotated upward to expose the fan 130 to permit access to the area enclosed by the housing 114. The bearing holes 198 rotationally support the hinge pins 82, which provide a pivot point for the fan plenum housing 114 so that the plenum housing 114 and the bearing 174 can rotate about the axis 100. In addition, the elongated aperture 142 and the bearing 174 cooperatively permit vertical or axial adjustment of the plenum housing 114 relative to the connection point defined by the hinge pin 82 along the major axis 154 while inhibiting movement of the bearing 174 relative to the plenum housing 114 due to the two-point engagement between the bearing 174 and the housing 114 (i.e. engagement of the first protrusion 186 with the edges of the slot 146, and engagement of the second protrusion 190 with the edges of the slot extension 150).

More specifically, and with reference to FIGS. 10 and 11, the plenum housing 114 is movable or slidable relative to the bearing 174 along the major axis 154 (e.g., vertically) to alter a position of the plenum housing 114 relative to base 18 so that the rim 134 engages (or more significantly engages) the interior surface 48 to limit air infiltration through the housing 114 except through the fan 130. Stated another way, the plenum housing 114 can be adjusted to minimize gaps between the interior surface 48 and the rim 134. Vertical adjustment of the plenum housing 114 along the major axis 154 alters the angle of orientation of the rim 134 relative to the interior surface 48 to accommodate, for example, for the slope of the interior surface 48 relative to horizontal. Altering the position of the plenum housing 114 relative to the bearing 174 changes the point of attachment between the plenum housing 114 and the coil supports 70 so that the plenum housing 114 can sit higher or lower relative to those supports 70 to seal against the interior surface 48 of the case 14.

To adjust the relative position of the plenum housing 114, housing 114 is moved up or down such that the aperture slides along the outer, lateral extents of the first protrusion 186 and the second protrusion 190. FIG. 10 illustrates the plenum housing 114 in a first, uppermost position such that the bottom of the first protrusion 186 is aligned with the first axial extent 162 and the bottom of the second protrusion 190 is aligned with the third axial extent 170. In this position, the plenum housing 114 has been elevated relative to the coil supports 70 so that the rim 134 would be angled generally and slightly downward from the rear of the plenum housing 114 toward the front of the plenum housing 114 (i.e. right to left in FIG. 1).

FIG. 11 illustrates the plenum housing 114 in a second, lowermost position such that the top of the first protrusion 186 is aligned with the second axial extent 166 and the center of the second protrusion 190 is aligned with the first axial extent 170. In this position, the plenum housing 114 has been lowered relative to the coil supports 70 so that the rim 134 would be, for example, substantially horizontal or angled slightly upward (or at least angled downward less than in the first position) from the rear of the plenum housing 114 toward the front of the plenum housing 114 (i.e. right to left in FIG. 1). The plenum housing 114 has a plurality of axial positions along the major axis 154 between and including the first and second positions described and illustrated with regard to FIGS. 10 and 11. The positioning element 182, and more specifically the second protrusion 190, is coupled to the sides walls of the slot extension in each of the plurality of axial positions of the bearing to prevent rotation of the bearing 174 relative to the housing.

Various features and advantages of the invention are set forth in the following claims.

The invention claimed is:

1. A merchandiser comprising a case defining a product display area, the case including a base and an air passageway extending from the base and in fluid communication with the product display area;

a plenum housing coupled to the case and substantially enclosing an end of the air passageway, the plenum housing defining an opening configured to receive a fan to direct air into the air passageway, and the plenum housing including a side wall having an elongated aperture with a major axis, the side wall having an edge oriented to engage a surface of the base;

a bearing coupled to the side wall and defining a pivot for the plenum housing, the bearing including a positioning element disposed within the aperture; and a hinge pin rotatably coupled to the bearing and defining a pivot about which the plenum housing is rotatable, wherein engagement of the positioning element with the aperture permits movement of the plenum housing relative to the bearing along the major axis to provide axial adjustment of the plenum housing while inhibiting rotational movement of the bearing relative to the plenum housing, and wherein axial adjustment of the plenum housing along the major axis is configured to alter a position of the plenum housing relative to the surface such that the edge of the plenum housing engages the base to limit air infiltration from adjacent the surface.

2. The merchandiser of claim 1, wherein the position of the plenum housing relative to the bearing is configured to alter the angle of orientation of the edge relative to the surface.

3. The merchandiser of claim 2, wherein the positioning element has a detent engaged with an inner surface of the side wall to retain the bearing within the aperture.

4. The merchandiser of claim 1, wherein the aperture is defined by a slot and a slot extension, and wherein the positioning element is disposed in the slot and the slot extension.

5. The merchandiser of claim 4, wherein the bearing includes a base plate, and wherein the positioning element includes a first protrusion extending from the base plate into the slot and a second protrusion extending from the base plate into the slot extension, and wherein the second protrusion inhibits rotation of the bearing relative to the plenum housing.

6. The merchandiser of claim 4, wherein the bearing has a first position relative to the plenum housing when the positioning element is engaged with a first axial extent of the slot, and a second position relative to the housing when the positioning element is engaged with a second axial extent of the slot opposite the first axial extent, and wherein the bearing has a plurality of axial positions relative to the plenum housing between and including the first and second positions.

7. The merchandiser of claim 6, wherein the positioning element includes a first protrusion disposed in the slot and a second protrusion disposed in the slot extension, and wherein the second protrusion is coupled to the side wall within the slot extension in each of the plurality of axial positions of the bearing.

* * * * *